United States Patent [19]

Hosken

[11] 4,265,002

[45] May 5, 1981

[54] MAGNETIC FASTENING MEANS

[76] Inventor: James C. Hosken, 329 Fox Hill St., Westwood, Mass. 02090

[21] Appl. No.: 66,086

[22] Filed: Aug. 13, 1979

[51] Int. Cl.[3] ..... A44B 17/00

[52] U.S. Cl. ..... 24/201 B

[58] Field of Search ..... 24/201 B, 73 MS, 104, 24/108, 107, 90 HA; 292/251.5

[56] References Cited

U.S. PATENT DOCUMENTS

| | | | |
|---|---|---|---|
| 2,906,553 | 9/1959 | Wilson | 292/251.5 |
| 3,141,216 | 7/1964 | Brett | 24/201 B |
| 3,206,818 | 9/1965 | Knowlton | 24/90 HA |
| 3,324,521 | 6/1967 | Humiston | 24/201 B |
| 3,372,443 | 3/1968 | Daddona, Jr. | 24/201 B |
| 3,462,803 | 8/1969 | Horton | 24/90 HA |
| 3,919,743 | 11/1975 | Cutler | 24/201 B |
| 4,021,891 | 5/1977 | Morita | 24/201 B |

*Primary Examiner*—Roy D. Frazier

*Assistant Examiner*—Peter A. Aschenbrenner

*Attorney, Agent, or Firm*—Russell & Nields

[57] ABSTRACT

Fastening means for a pair of flaps or the like are provided having first and second ferromagnetic plates, an elongated ferromagnetic element of cross-sectional area smaller than the area of the surfaces of either plate affixed at one end thereof substantially normal to a surface of the first of the plates, and magnetic means affixed in close proximity to the elongated element along a substantial portion, but not all, of its length. It is also contemplated that the above elements will be mounted by means of first and second thermoplastic mounting elements upon a pair of thermoplastic strips, which strips are affixable to facing surfaces of the flaps, in such a way that the nonsecured end of the elongated element releasably lockably engages a surface of the second plate in flush abutting relation when the fastening means is in the closed position.

1 Claim, 7 Drawing Figures

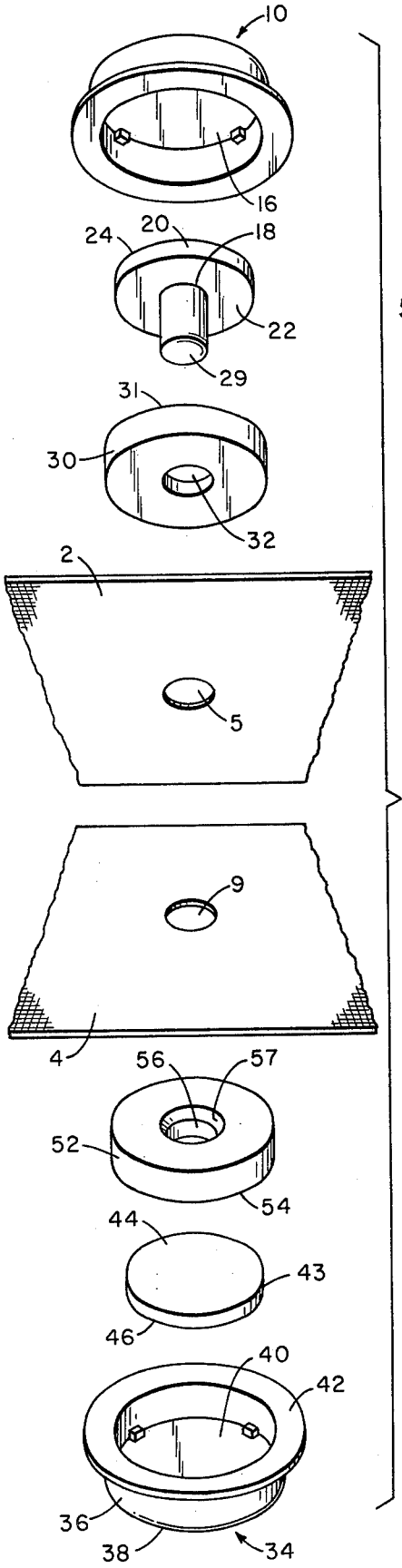
FIG. 1
FIG. 3
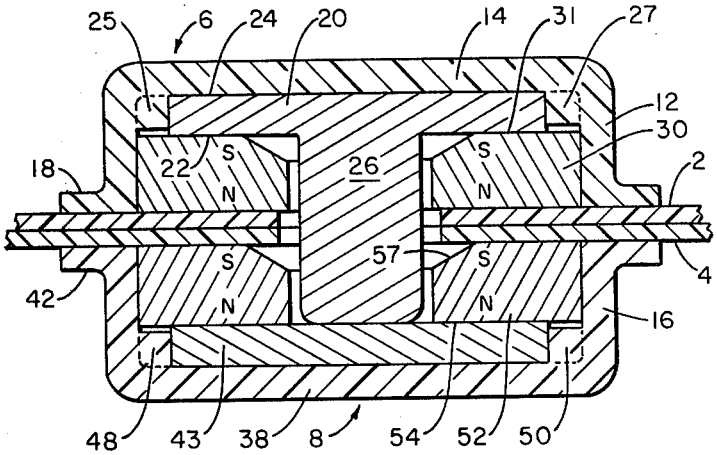
FIG. 2
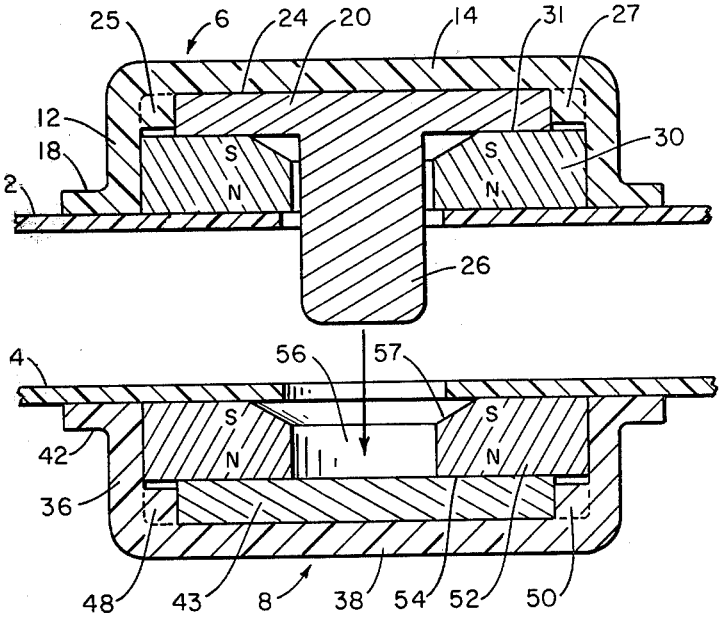

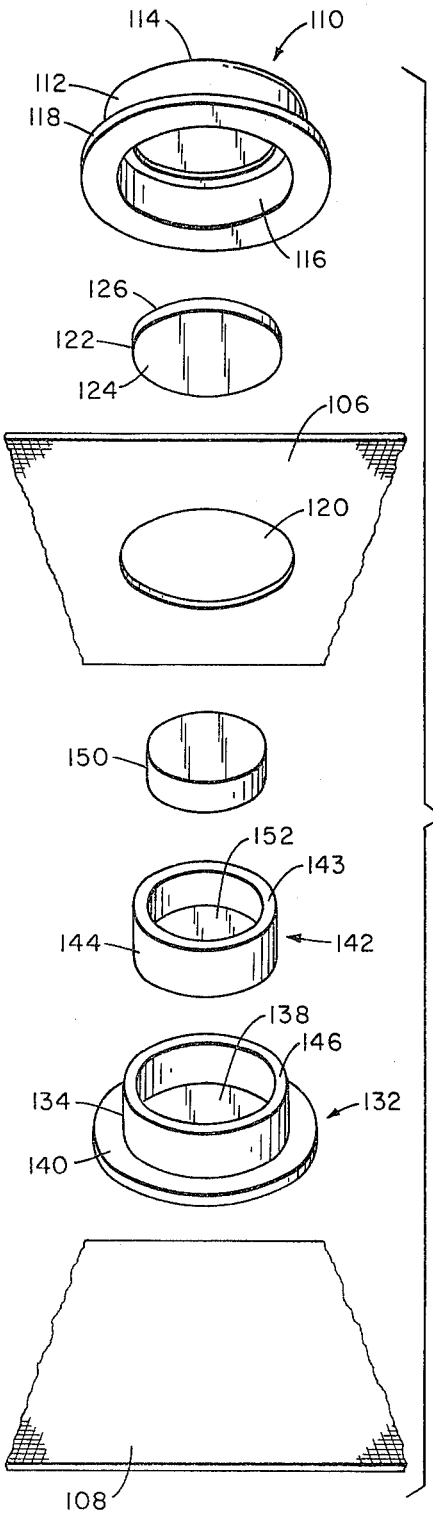
FIG. 4
FIG. 5
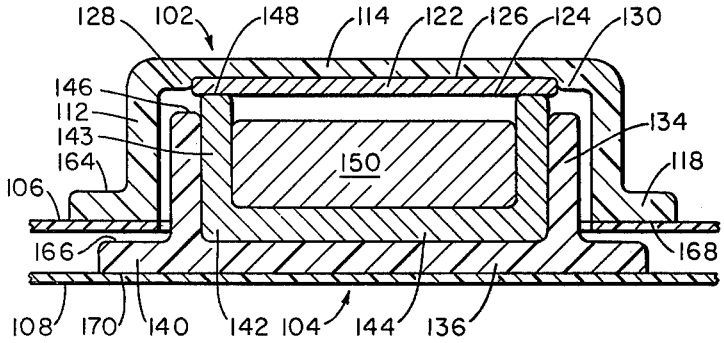
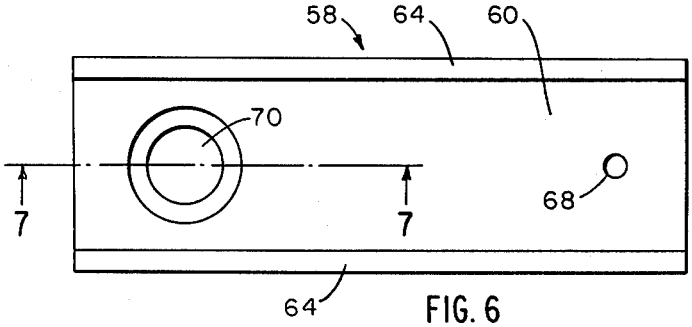
FIG. 6
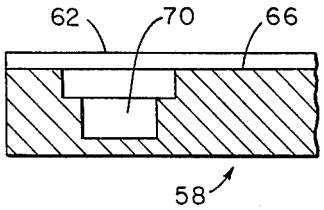
FIG. 7

MAGNETIC FASTENING MEANS

BACKGROUND

1. Field of Invention

The present invention relates to improved fastening means for a pair of flaps or the like, and more particularly to improved magnetic fastening means for use in place of buttons, snaps, and the like.

2. Brief Summary of the Prior Art

Conventional fastening means such as buttons, snaps, and the like, are presently and will probably remain for the forseeable future, the most widely used devices for releasably joining a pair of fabric flaps or the like. The reasons for this are simple. Conventional fastening devices are generally uncomplicated devices which are easy to use, and inexpensive to manufacture and install. Despite these facts, however, there remain certain situations in which, and certain individuals to whom, the use of such conventional fastening means are not particularly well adapted. Thus, for example, in the fashion context the visible presence of a button or snap may be considered to be aesthetically unsatisfactory, yet the closure required may not be adapted for the use of a zipper or other conventionaL device. Similarly, conventional buttons and snaps in other contexts may be inappropriate where exposure to the elements may cause rusting, leakage, or other forms of damage. Various attempts to alleviate these problems are present in the art, including the use of comparatively expensive weatherproofing materials and the use of protective flaps which render the operation of the fastener somewhat awkward. Also, for some people, most notably the elderly, the very young, and those who for one reason or another lack normal manual dexterity, the operation of conventional fastening means, including zippers and even Velcro fasteners as well as conventional buttons and snaps, is extremely difficult.

In response to the above deficiencies, fastening means relying upon magnets to releasably hold a pair of flaps or the like together have been developed in an attempt to facilitate the fastening and unfastening operations. Heretofore, such devices have relied upon direct flush abutting contact between magnetic surfaces of opposite polarities, or between a magnetic surface and a ferromagnetic surface, to establish the desired releasable locking engagement.

As used herein the terms "magnetic" and "ferromagnetic" are used to distinguish between permanently magnetized surfaces and surfaces which may be temporarily magnetized when in contact with or in close proximity to a permanent magnet, respectively. U.S. Pat. No. 3141216 to Brett, issued July 21, 1964, is exemplary of such devices. It will be understood, however, that such prior devices have been found to be economically impractical due to their weight in comparison to conventional devices, their thickness in comparison to the flaps they are intended to join and the inherent difficulty of mounting the operative fastening elements so as to allow direct flush abutting contact therebetween. Brett shows the later of these problems clearly. Thus, if the operative elements are to be located in holes in the flaps there must be some sort of mechanical link between the flap and the fastener to maintain the fastening elements in position. In such a case the periphery of the holes in the flaps is the weakest portion of the link and is vulnerable to tearing with a resultant dislodging of the fastener. Alternatively, if the fastener is mounted without making a hole in the flap, for example by crimping a portion of the flap between the operative elements and a cap, the operation of the device itself will require the exertion of forces which tend to pull the fastener apart thereby dislodging it from the flap.

II. SUMMARY OF THE PRESENT INVENTION

The present invention provides an improved means for releasably fastening a pair of flaps or the like together by means of magnetic attractive forces. More particularly the present invention contemplates a magnetic fastening means wherein fastening is accomplished between two ferromagnetic elements in a magnetic field rather than by direct engagement between a pair of magnets. Specifically, a fastening means is provided having first and second ferromagnetic plates, an elongated ferromagnetic element of cross sectional area smaller than the area of the surface of either plate affixed to one end thereof substantially normal to a surface of the first of the plates, and magnetic means affixed in close proximity to (permissably including direct contact with) the elongated element along a substantial portion, but not all, of its length. The present invention further contemplates that the above operative elements will be mounted upon a pair of thermoplastic strips, which strips are affixable to facing surfaces of the flaps, by means of first and second thermoplastic mounting elements which are adapted to receive and hold the respective plates. The mounting elements are contemplated to be affixed to the respective strips in such a way that the nonsecured end of the elongated element releasably lockably engages a surface of the second plate in flush abutting relation when the device is closed.

It is thus an object of the present invention to provide an improved magnetic fastening means for two members which is lightweight, economical to manufacture and install and yet easily manipulable into and out of a secure fastening position.

It is also an object of the present invention to provide an improved magnetic fastener of the type described which is not visible when the members are joined thereby maintaining the aesthetic beauty of the joined members and protecting the fastener from the external environment.

It is further an object of the present invention to provide an improved magnetic fastener of the type described which requires only approximate alignment of the mounting means as the respective members are brought together to effecutate engagement.

Still further it is an object of the present invention to provide an improved fastening means of the type described which is securely mountable to the members to be joined without rendering the members vulnerable to damage or the fastening means vulnerable to dislodgement.

BRIEF DESCRIPTION OF THE DRAWINGS

These, as well as other features, objects, and advantages of the present invention will be more clearly understood by reference to the following detailed description of exemplary embodiments of the present invention and to the drawings in which:

FIG. 1 is an exploded perspective view of a fastening device in accordance with the present invention;

FIG. 2 is a vertical section of the fastening means of FIG. 1 wherein the two fastening members are shown in open or separated relation;

FIG. 3 is a view similar to FIG. 2, but showing the fastening members in closed relation;

FIG. 4 is an exploded perspective view of a second embodiment of a fastening device in accordance with the present invention;

FIG. 5 is a vertical section of the fastening means of FIG. 4, wherein the two fastening members are shown in closed relation;

FIG. 6 is a top view of a jig suitable for use in the assembly of a fastening device in accordance with the present invention; and FIG. 7 is a side section of a portion of the jig of FIG. 6 taken along the line 7—7.

DETAILED DESCRIPTION OF PREFERRED EMBODIMENTS

Referring now specifically to the drawings it will be noted that a first (FIG. 1-3) and a second (FIG. 4-5) embodiment of a magnetic fastening means in accordance with the present invention is shown, while FIGS. 7 and 8 show a jig suitable for use in the assembly of the respective fastening members of the present invention as hereinafter more fully appears.

With reference to the first embodiment, it will be seen from the drawings that a pair of correspondingly apertured thermoplastic strips 2 and 4 are provided. These strips are adapted to be affixed, by sewing or other convenient means, to facing surfaces of the flaps (not shown) such that the apertures 5 and 9 of the respective strips will be in alignment when the flaps are in the desired relative special orientation for fastening.

Fastening member 6 includes a first thermoplastic support cup 10 having peripheral wall portion 12 and an end wall portion 14 collectively defining a mounting cavity 16, and flange portion 18 extending outwardly of the peripheral wall 12 adjacent the open end of the cavity 16. The flange 18 is affixed to the side of strip 2 which is to be adjacent a flap, on center about the aperture 5 therein. A first ferromagnetic plate 20 having an upper surface 22 and a lower surface 24 is affixed by frictional engagement with projections 25 and 27, or by other convenient means such as gluing, within the mounting cavity 16 such that its lower surface 24 is substantially flush against end wall portion 14. A ferromagnetic post 26 having an inner end 28, an outer end 29, a cross sectional area smaller than the area of surface 22 and smaller than the area defined by apertures 5 and 9, and a length greater than twice the distance between surface 22 and the open end of cavity 16, is affixed substantially centrally of and normal to surface 22 at end 28 thereof so as to extend upwardly through aperture 5. Optionally, plate 20 and post 26 may be formed as an integral unit. Disposed between surface 22 and strip 2 within cavity 16 is a first annular magnet 30 such that a surface 31 thereof of one polarity lies adjacent upper surface 22 of plate 20 and such that post 26 extends through central opening 32 thereof.

Fastening member 8, on the other hand, comprises a second thermoplastic support cup 34, substantially identical to support cup 10, having a peripheral wall portion 36 and an end wall portion 38 collectively defining a second mounting cavity 40, and flange portion 42 extending outwardly of the peripheral wall 36 adjacent the open end of the cavity 40. The flange 42 is affixed to the side of strip 4 which is to be adjacent a flap, on center about aperture 9 therein. A second ferromagnetic plate 43, substantially identical to plate 20, having an upper surface 44 and a lower surface 46 is affixed by frictional engagement with projections 48 and 50, or by other convenient means such as gluing, within said mounting cavity 40 such that its lower surface 46 is substantially flush against end wall 38. Disposed between surface 44 and strip 4 within cavity 40 is a second annular magnet 52 such that a surface 54 thereof, of opposite polarity to the polarity of surface 31 of magnet 30, lies adjacent to surface 44 of plate 43 and such that the central opening 56 therein is aligned on center with aperture 9. It should also be understood that the edges of apertures 5 and 9 are preferrably fused to prevent tearing of strips 2 and 4, and that the area between the apertures and the flange attachment may be reinforced if desired. I have in fact found that initially fusing the entire area of the strips about which the support cups are to be attached greatly facilitates the formation of the apertures by a simple punch out method and also acts to reinforce the strip.

Assembly of this device is preferably accomplished using an ultrasonic tool to weld te strips to the flanges of the respective support cups. Ultrasonics is preferred because it is easier to control than conventional heat welding yet results in a similar weld. I have also found that a jig 58, substantially as shown in FIGS. 6 and 7, facilitates assembly of the present fastening means. This jig is preferably a unitary, milled, substantially rectangular metallic member adapted to fit under the welding head of a conventional ultrasonic welder. Milled in the top surface 62 of the jig 58 is a slot 60 such that rails 64 and surface 66 allow one of the thermoplastic strips to lie substantially flat against surface 66 and be held substantially stationary between rails 64.

Means such as hole 68 designed to fit a mounting pin on the welding machine are provided for holding the jig stationary relative to the welding machine (not shown). Also, as the cross-sections apertures 5 and 9 are larger than the cross section of post 26 to facilitate engagement of the fastener along the sloped edges 57 of magnet 52, it is convenient to construct jig 58 such that the pin projecting through hole 68 from the welding machine projects through the aperture in the strip adjoining the aperture about which the support cup flanges are being welded in such a way that the alignment of the aperture and the central opening of the magnet is maintained during the welding operation. Cavity 70 is drilled or milled such that the respective support cups will fit therein with the flanges substantially flush with surface 66. In the preferred case, the flanges will be flush with surface 66 and be provided with projections (not shown) extending above surface 66. In this case the assembler simply places an assembled fastening member into cavity 70, places the thermoplastic strip over the fastening member in slot 60, such that the aperture is aligned with the central opening in the magnet and the adjoining aperture is hooked over the pin projecting through hole 68, and then activates the ultrasonic welder which melts and squashes the projections as well as partially melting the strip in the area of contact with the flange thereby forming a strong weld between the flange and strip.

It will be understood that any desired number of fastening members may be attached to a single strip in this manner, and that large economies of scale may be realized in attaching a plurality of fastening members to the same strip at the same time. The completed strips are then appropriately affixed to the respective flap surfaces to be joined such that fastening members of one type are always maintained opposite fastening members of the other type.

The design of this fastening means is such that the magnets need not come in direct contact with each other. Instead the magnetic fields present in the female member actually draw the end 29 of the post 26 of the male member into engagement with surface 44 of plate 42 as the fastening members are brought together thereby avoiding the squeezing needed to engage snaps and the push-pull forces needed to engage buttons. If perchance the post fails to engage aperture 9 and the central opening in magnet 52 thereunder, the necessary alignment, which need only be approximate to result in appropriate engagement, is a simple matter even for a handicapped individual. Relatively strong magnets are used to assure the security of the engagement. However, as the area of contact between the post 26 and the plate 42 is small, the axial movement of the fastening members away from each other necessary for disengagement of the device is a relatively simple manipulation.

The second embodiment shown is similar in operating principle and assembly to the first yet may prove superior thereto at such time as powerful yet small rare earth magnets such as samarium cobalt become readily and economically available. In this embodiment the fastening members 102 and 104 are ultrasonically welded to thermoplastic strips 106 and 108, however, in this case fastening member 102 includes a support cup 110 having peripheral walls 112 and an end wall 114 forming a mounting cavity 116, and a flange 118 extending outwardly from the open end of cavity 116, said flange being welded to the periphery of an aperture 120 in strip 106. A ferromagnetic plate 122 having an upper surface 124 and a lower surface 126 is affixed within cavity 116 by frictional engagement with projections 128 and 130, gluing, or other convenient means, with its lower surface 126 against end wall 114.

Fastening member 104, on the other hand, includes a support cup 132 having peripheral walls 134 substantially shorter than walls 112 and an end wall 136 collectively forming a mounting cavity 138, and a flange 140 extending outwardly of wall 134 adjacent the closed end of cavity 138. The open end of cup 132 is further adapted to fit within cavity 116 in telescoping relation. A ferromagnetic cup 142 having peripheral walls 143 and an end wall 144 is affixed within cavity 138 such that end wall 144 lies adjacent to end wall 136 and peripheral walls 143 extend beyond the outer ends 146 of walls 134. Additionally, the outer ends 148 of walls 143 are designed to bear against surface 124 when the fastener is closed. A magnet 150 is affixed within the cavity 152 formed by walls 143 and 144, adjacent wall 144; the magnet extending upwardly from wall 144 less than the height of wall 142.

It will further be seen that fastening members 102 and 104 may be mounted substantially as above described to thermoplastic strips 106 and 108 either to the upper surfaces 164 and 166 of flanges 118 and 140, to the lower surfaces 168 and 170 thereof, or to a combination thereof according to whether or not the particular application lends itself to the presence of apertures in either, both, or neither of the strips.

This second embodiment has several distinct advantages, provided small, lightweight magnets of sufficient strength are available to assure secure fastening at economical cost. In addition to being lightweight and providing a very secure lock in the closed position due to the increased area of contact between the temporarily magnetized ferromagnetic cup 142 and plate 122, the fastener when closed is thinner due to the telescoping engagement feature and is thus more aesthetically pleasing in its approximation of conventional fasteners. The fastener unit is also more rigid, stronger, and less likely to disengage unintentionally due to extraneous forces due to the telescoping engagement of the fastening member. The device itself is additionally easier to use because it approximates a snap and is thus familiar and provides a comparatively large area for engaging the male with the female member.

It should be understood that the embodiments and practices described and portrayed herein have been presented by way of disclosure, rather than limitation, and that various modifications, substitutions, and combinations may be effected without departure from the spirit and scope of this invention in its broader aspects.

I therefore claim:

1. Magnetic fastening means for a pair of flaps or the like comprising a ferromagnetic plate having an upper surface and a lower surface, a ferromagnetic cup having peripheral walls and an end wall, the cross sectional area of said peripheral walls being no greater than the area of the upper surface of said plate, a magnet having a first surface and a second surface of opposite polarities and a height less than that of the peripheral walls of the ferromagnetic cup affixed within said cup such that its first surface lies against the end wall thereof, a pair of thermoplastic strips affixable to facing surfaces of the flaps, female mounting means affixed to one of said strips holding said plate substantially parallel to said strip, and male fastening means affixed to the other of said strips holding said ferromagnetic cup such that the end wall thereof is substantially parallel to said other strip and such that said peripheral walls thereof may releasably engage said plate.

* * * * *